US006356249B1

(12) United States Patent
Lim

(10) Patent No.: US 6,356,249 B1
(45) Date of Patent: Mar. 12, 2002

(54) METHOD OF DRIVING PLASMA DISPLAY PANEL

(75) Inventor: Geun Soo Lim, Sungnam-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/356,512

(22) Filed: Jul. 19, 1999

(51) Int. Cl.[7] ..... G09G 3/28
(52) U.S. Cl. ..... 345/66; 345/63
(58) Field of Search ..... 345/60, 63, 66, 345/67, 68, 208–210; 315/169.1, 169.4

(56) References Cited

U.S. PATENT DOCUMENTS 5,483,252 A * 1/1996 Shigeta et al. ..... 345/67
5,790,087 A * 8/1998 Shigeta ..... 345/67

* cited by examiner

*Primary Examiner*—Regina Liang
(74) *Attorney, Agent, or Firm*—Fleshner & Kim, LLP

(57) ABSTRACT

A plasma display panel driving method that is capable of improving the brightness in driving a plasma display panel by a sub-frame system. In the sub-frame system, a plurality of scanning lines spaced at an interval corresponding to a multiple of 2 in accordance with a gray scale are simultaneously selected to initiate a discharge. The plurality of scanning lines are sequentially addressed by an erasing discharge according to a data. The discharge of the addressed scanning lines is sustained by a certain period of sustaining pulses. The driving method performs an addressing of the plurality of scanning lines by dispersing it in a plurality of sustaining pulse periods. Accordingly, an addressing time per sustaining pulse is reduced to thereby increase a frequency of the sustaining pulse, so that the brightness of the PDP can be improved.

5 Claims, 11 Drawing Sheets

METHOD OF DRIVING PLASMA DISPLAY PANEL

BACKGROUND OF THE INVENTION

1. Field of the Invention

This invention relates to a method of driving a plasma display panel which is capable of improving the brightness in driving the plasma display panel in a sub-frame method.

2. Description of the Related Art

Recently, a plasma display panel(PDP) feasible to the fabrication of large-scale panel has been available for a flat panel display device. The PDP controls a discharge interval of each pixel to display a picture. Such a PDP typically includes a PDP of alternating current(AC) system having three electrodes and driven with an AC voltage as shown in FIG. 1.

The PDP shown in FIG. 1 includes a display panel 10 having 480×1920 discharge cells arranged in a matrix pattern, a controller 20 for converting an input video signal into a digital video data and for generating control signals, a first sustaining driver 14 for responding to a control of the controller 20 to drive first sustaining electrodes Y1 to Y480, a second sustaining driver 16 for responding to a control of the controller 20 to drive second sustaining electrodes Z1 to Z480, and an address driver 18 for responding to a control of the controller 20 to drive address electrodes A1 to A1920. The display panel 10 has 480×1920 red(R), green(G) and blue(B) discharge cells 12 arranged in a matrix pattern to display a color picture of 480×640 resolution. To this end, the display panel 10 includes 480 first sustaining electrodes Y1 to Y480 arranged, in parallel, in the vertical direction, second sustaining electrodes Z1 to Z480 arranged alternately with the first sustaining electrodes Y1 to Y480, and 1920 address electrodes X1 to X1920 arranged perpendicularly to the first and second sustaining electrodes Y1 to Y480 and Z1 to Z480 with having a discharge space therebetween. Discharge cells 12 are provided at each intersection between the first and second sustaining electrodes Y1 to Y480 and Z1 to Z480 and the address electrodes X1 to X1920. Accordingly, in the discharge cell 12, as shown in FIG. 2, the first and second sustaining electrodes Yi and Zi are formed, in parallel, on an upper substrate 22, and the address electrodes Ai are formed on a lower substrate 28. The first sustaining electrodes Yi and the address electrodes Ai allows an address discharge to be generated. The first and second sustaining electrodes Yi and Zi keep a discharge. A dielectric layer 24 and MgO protective film 26 is sequentially disposed on the upper substrate 22 formed with the first and second sustaining electrodes Yi and Zi. The dielectric layer 24 accumulates an electric charge during the discharge and limits a discharge current. The protective film 26 protects the dielectric layer 24 and the first and second sustaining electrodes Yi and Zi from a sputtering followed during the discharge. A fluorescent layer 30 generating R, G and B visible lights is coated on the lower substrate 28 formed with the address electrode Ai. The fluorescent layer 30 is usually coated to extend until the vicinity of the upper edge of a barrier rib(not shown). The barrier rib is formed in parallel to the address electrodes Ai between the upper substrate 22 and the lower substrate 28. A discharge gas for emitting an ultraviolet(UV) is injected into the discharge space during the discharge. In the discharge cell with the structure as described above, an address discharge is caused by a voltage difference between a data signal applied to the address electrodes Ai and a scanning signal applied to the first sustaining electrodes Yi to generate a wall charge. The discharge is sustained by the wall charge and a sustaining pulse applied alternately to the first and second sustaining electrodes Yi and Zi. A fluorescent layer 30 is radiated by an ultraviolet generated at the time of this sustaining discharge to emit a visible light into the exterior.

In FIG. 1, the controller 20 digitizes an analog image signal VIDEO inputted from the exterior to convert it a digital video data, and separates and outputs the digital video data for each bit. Also, the controller 20 outputs the video data on a basis of a clock signal CLK, a horizontal synchronous signal HS and a vertical synchronous signal VS and generates various control signals. The first sustaining driver 12 responds to a control signal from the controller 20 to apply a scanning signal, etc. to the 480 first sustaining electrodes Y1 to Y480. The second sustaining driver 14 responds to a control signal from the controller 20 to apply a discharge sustaining signal to the 480 second sustaining electrodes Z1 to Z480 commonly. The address driver 18 responds to a video data and a control signal from the controller 20 to apply a video data signal to the 1920 address electrodes A1 to A1920.

Accordingly, the PDP allows the discharge cells 12 arranged in a matrix pattern to be selectively radiated in accordance with a video data signal to display a picture corresponding to the video data signal. In this case, the PDP employs a modulation technique in which a radiation frequency is proportional to a video signal to implement a gray level. Specifically, as shown in FIG. 3, one frame interval is divided into sub-field intervals corresponding to the bit number of the digitized video data. In each sub-field interval, a radiation having the frequency proportional to a weighting value of the video data is progressed to provide a gray scale display.

For instance, when a picture is displayed in 256 gray scales by making use of 8 bit video data, one frame display interval (e.g., 1/60 sec=16.7 msec) in each discharge cell 12 is divided into 8 sub-field intervals SF1 to SF8 as shown in FIG. 3. Each sub-field interval SF1 to SF8 is again divided into a reset interval RP, an address interval AP and a sustaining interval SP. A weighting value is given at a ratio of 1:2:4:8: . . . :128 in the sustaining interval SP. Herein, the reset interval RP is a time period for initializing the discharge cell, the address interval AP is a time period for causing a selective address discharge in accordance with a logical value of the video data, and the sustaining interval SP is a time period for allowing the discharge to be maintained at the discharge cell generating the address discharge. The reset interval RP and the address interval AP are equally assigned in each sub-field interval.

A driving technique of separating the reset, address and sustaining intervals every sub-field interval is called "sub-field driving method". In such a sub-field method, a display sequence of the sub-field corresponding to each bit is made by a certain sequence of SF1, SF2, SF3, SF4, SF5, SF6, SF7 and SF8 as shown in FIG. 4. In the address interval of each sub-field SF1 to SF8, one bit data of 8 bit video data corresponding to each discharge cell is applied in a line sequence to cause a selective address discharge. Specifically, least significant bit data are applied in the address interval of the first sub-field SF1, next least significant bit data are applied in the address interval of the second sub-field SF2, and most significant bit data are applied in the address interval of the eighth sub-field SF8. In the sustaining interval of each sub-field SF1 to SF8, the discharge is maintained only at the discharge cell generating the address discharge. In this case, in the sustaining interval SP of each sub-field SF1 to SF8, a weighting value is given at a ratio of 1:2:4:8: . . . :128 and a gray scale display corresponding to the weighting value is carried out. Gray scales displayed at each sub-field in one frame interval are combined to implement one gray scale in 256 levels.

However, the above-mentioned sub-field driving method has a problem in that the brightness and the luminous efficiency are low. More specifically, assuming that one frame interval is 1/60 second, that is, 16.67 ms and a time required for addressing one scanning line is 3 μs, a time of 3 μs×480 is required for an address interval of each sub-field and therefore a time of 3 μs×480×8=11.52 ms is required for the total address interval of one frame. As a result, since a time contributing to a real brightness in one frame interval (i.e., 16.67 ms) is only 5.15 ms, the PDP has a low brightness as well as a low luminous efficiency of 31%. In other words, the sub-field driving method causes an invalid time unable to contribute to the brightness because the entire field is addressed every sub-field, thereby having a low brightness and a low luminous efficiency.

A scheme of implementing the gray scale using the sub-frame driving method has appeared as a scheme for improving the low brightness and the low discharge efficiency. In the sub-field driving method, an addressing process of the discharge cells is performed in such a manner that it is divided by a certain portion while applying a constant frequency of sustaining pulses successively, whereby the sustaining process is continuously progressed without an interruption. In this case, as shown in FIGS. 5A and 5B, groups of the discharge cells having different bit weighting values exist simultaneously on a single picture.

Referring now to FIGS. 5A and 5B, an operation sequence of the corresponding scanning line according to the sub-frame driving method for an expression of 256 gray scales is represented. In the sub-frame driving method, when a picture of 256 gray scales is displayed on a PDP having 480 scanning lines, the number of scanning lines is assumed to be 560 and 510 sustaining pulses are applied in one frame interval. 8 scanning lines having line spaces of T, T/2, T/4, T/8, T/16, T/32, T/64 and T/128 are selected in accordance with the bit weighting value every period of the sustaining pulses and then addressed to maintain the discharge. More specifically, during the first sustaining pulse period, as shown in FIG. 5A, 8 scanning lines L1, L257, L385, L449, L481, L497, L505 and L509 are selected and addressed to maintain the discharge. In this case, upon addressing, the bit data B0, B7, B6, B5, B4, B3, B2 and B1 having a different weighting value in the 8 bit video data are supplied to the 8 scanning lines L1, L257, L385, L449, L481, L497, L505 and L509, respectively. Next, during the second sustaining pulse period, as shown in FIG. 5B, 8 scanning lines L2, L258, L386, L450, L482, L498, L506 and L510 incremented by one line are selected and addressed to maintain the discharge. In this case, upon addressing, the bit data B0, B7, B6, B5, B4, B3, B2 and B1 are supplied to the 8 scanning lines L2, L258, L386, L450, L482, L498, L506 and L510, respectively. An addressing process shifted by one line in this manner is performed as shown in FIG. 6. Then, when the corresponding scanning lines L510, L254, L126, L62, L30, L14, L6 and L2 are selected and addressed during the last 510th sustaining pulse period to maintain the discharge, one frame interval is terminated. In this case, the discharge of the addressed scanning lines is maintained until the next address interval. In other words, the scanning lines which have not performed the addressing process carry out a discharge maintenance process according to the sustaining pulses. As a result, when 510 sustaining pulses are used for the 256 gray scale expression, B0 in the 8 bit video data has a bit weighting value corresponding to 2 sustaining pulses; B1 has a bit weighting value corresponding to 4 sustaining pulses; B2 has a bit weighting value corresponding to 8 sustaining pulses; B3 has a bit weighting value corresponding to 16 sustaining pulses; B4 has a bit weighting value corresponding to 32 sustaining pulses; B5 has a bit weighting value corresponding to 64 sustaining pulses; B6 has a bit weighting value corresponding to 128 sustaining pulses; and B7 has a bit weighting value corresponding to 256 sustaining pulses.

In the sub-frame driving method as described above, since the sustaining pulses are successively applied and the addressing process is performed dispersively every sustaining pulse period such that an unnecessary time unable to contribute to the brightness in the conventional sub-field driving method does not almost exist, the brightness and the luminous efficiency can be improved. However, such a sub-frame method also fails to obtain a desired brightness because it causes a limit in increasing a frequency of the sustaining pulse proportional to the brightness. Hereinafter, a problem in the above-mentioned sub-frame driving method will be described in detail with reference to the accompanying drawings.

An addressing method in the sub-frame driving technique is largely classified into a selective writing method and a selective erasing method. The selective writing method carries out an addressing by causing a writing discharge according to a logical value of the data after simultaneously applying an erasing pulse to scanning lines to be addressed to erase the sustaining discharge in the earlier stage. The selective erasing method carries out an addressing by erasing the discharge in accordance with a logical value of the data after simultaneously applying a writing pulse to scanning lines to be addressed to generate a writing discharge. By the way, the writing pulse has usually a higher voltage and a larger pulse width than the erasing pulse. Due to this, an address interval unable to contribute to the brightness becomes relatively short when the selective erasing method is employed, so that the selective erasing method has an advantage in that it has a better brightness than the selective writing method.

FIG. 7 shows a portion of driving waveforms corresponding to a case where an addressing is performed by employing a selective erasure in the sub-frame driving method. Referring to FIG. 7, when the number of scanning lines is 510 as mentioned above, sustaining pulses having the same frequency and an opposite polarity are successively applied to the first sustaining electrodes Y1 to Y510 and the second sustaining electrodes Z1 to Z510. 8 scanning lines L1, L257, L385, L449, L481, L497, L505 and L509 to be addressed in the first sustaining interval S1 applied with the first sustaining pulse are selected such that they are addressed by the selective erasing method. More specifically, a writing pulse WP is simultaneously applied to the first sustaining electrodes Y1, Y257, . . . , Y509 and the second sustaining electrodes Z1, Z257, . . . , Z509 in a writing region A of the first sustaining interval S1 to thereby generate a writing discharge. In this case, the writing pulse WP is applied in a shape added to the sustaining pulse. Subsequently, the discharge is maintained in a sustaining region B applied with a sustaining pulse having a contrary polarity with respect to the writing region A. Then, an erasing pulse is line-sequentially applied to the first sustaining electrodes Y1, Y257, . . . , Y509 of the corresponding scanning lines L1, L257, L385, L449, L481, L497, L505 and L509 in an address region C. At the same time, a data pulse corresponding to the scanning lines L1, L257, L385, L449, L481, L497, L505 and L509 is applied to data electrodes X1 to X1920 for one horizontal line. As a result, the discharge is selectively erased in accordance with a logical value of the data at the discharge cells of the corresponding scanning lines L1, L257, L385, L449, L481, L497, L505 and L509. Discharge cells in which the discharge has not been erased sustain the discharge until the next address interval by a sustaining pulse applied successively later. In the second sustaining interval S2 applied with the second sustaining pulse, scanning lines L2, L258, L386, L450, L482, L498, L506 and L510 incremented by one line from the 8 scanning lines L1, L257, L385, L449, L481, L497, L505, L509 are selected such that they are addressed by the selective erasing method as mentioned above. Each one line is shifted as described above every sustaining pulse period to perform an addressing process for 8 lines.

As described above, the conventional sub-frame driving method performs an addressing process by locking a frequency of the sustaining pulse and adding the writing pulse and the erasing pulse to the sustaining pulse. In this case, a time able to address all the 8 lines in one sustaining pulse period must be assured. Accordingly, the conventional sub-frame driving method has a limit in raising a frequency of the sustaining pulse determining a discharge frequency proportional to the brightness. As a result, the PDP could not overcome its inherent problem in that it fails to keep up with the brightness of cathode ray tube(CRT) even when the sub-frame driving method is employed.

SUMMARY OF THE INVENTION

Accordingly, it is an object of the present invention to provide a PDP driving method that is capable of increasing a frequency of the sustaining pulse by dispersing an addressing process performed every sustaining period into a plurality of sustaining periods to shorten an address time.

In order to achieve these and other objects of the invention, a plasma display panel driving method according to the present invention employs a sub-frame system including the steps of simultaneously selecting a plurality of scanning lines spaced at an interval corresponding to a multiple of two in accordance with a gray scale to initiate a discharge; sequentially addressing the plurality of scanning lines by an erasing discharge according to a data; and sustaining the discharge at the addressed scanning lines by a certain period of sustaining pulse, wherein an addressing for the plurality of scanning lines is performed with being dispersed in a plurality of sustaining pulse period.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
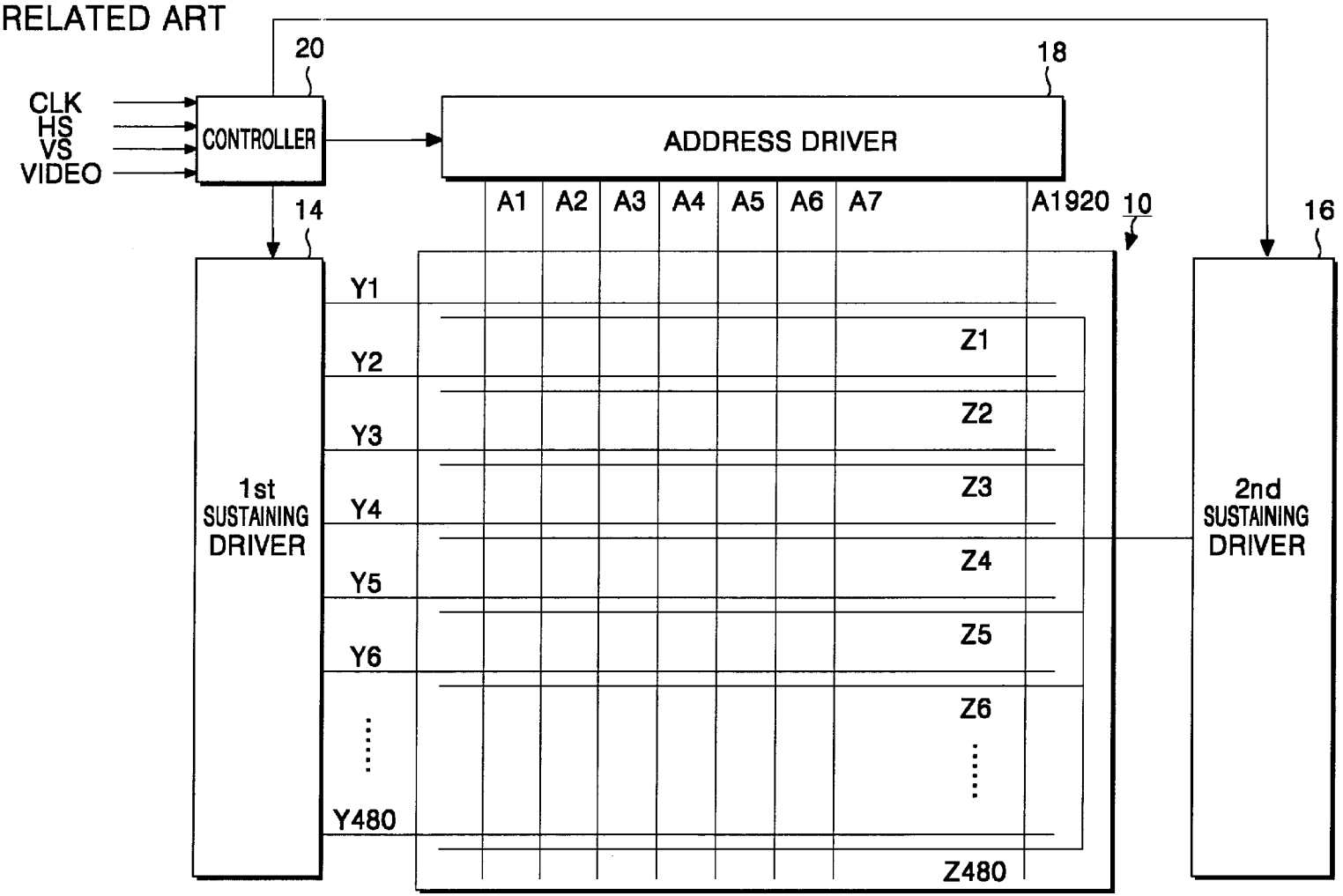
FIG. 1 RELATED ART
FIG. 1 is a schematic view showing the configuration of a conventional PDP driving apparatus of three-electrode AC system.
Figure 2:
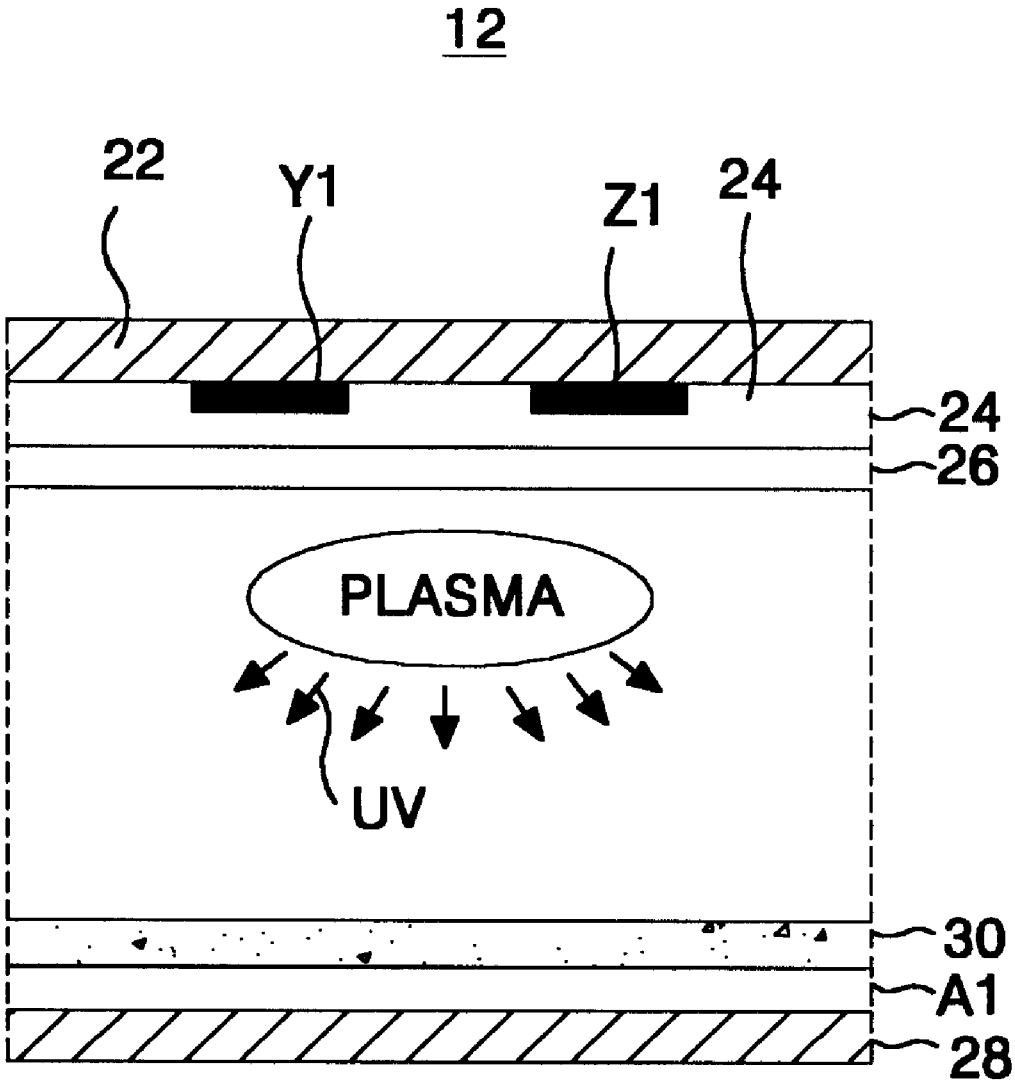
FIG. 2 RELATED ART
FIG. 2 is a sectional view of the discharge cell shown in FIG. 2.
Figure 3:
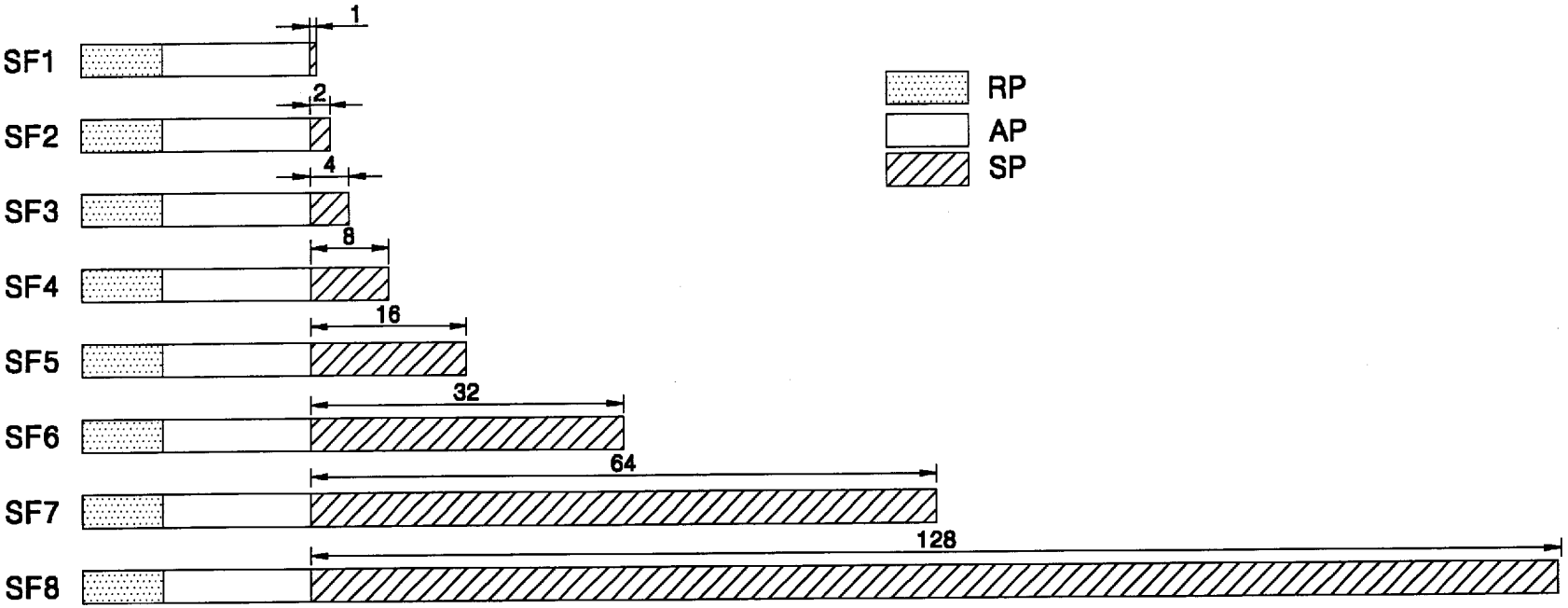
FIG. 3 RELATED ART
FIG. 3 shows a detailed structure of sub-fields constructing one frame.
Figure 4:
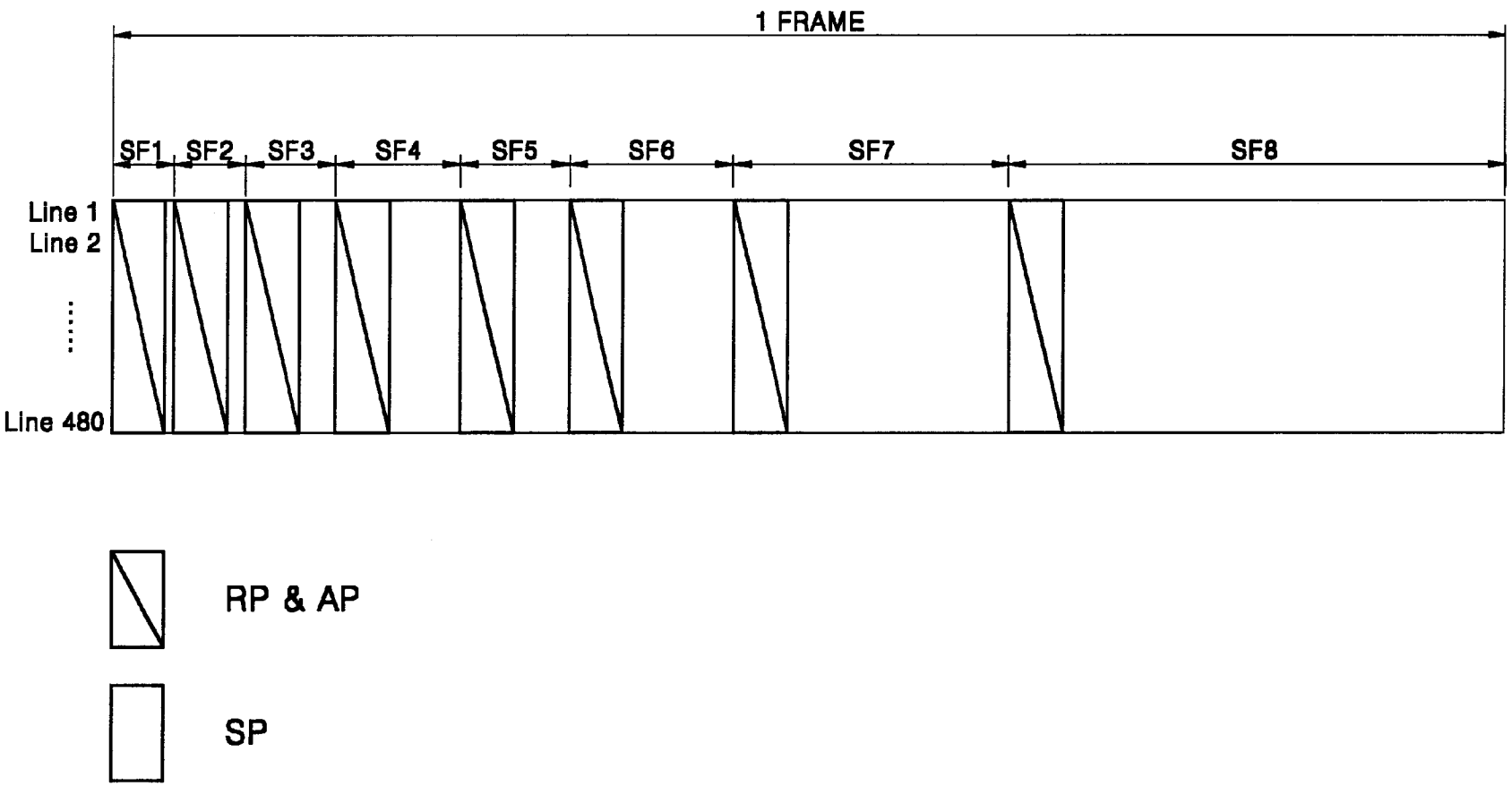
FIG. 4 RELATED ART
FIG. 4 shows a configuration of one frame in which the sub-fields shown in FIG. 3 is continued in a time sequence.
Figure 5A:
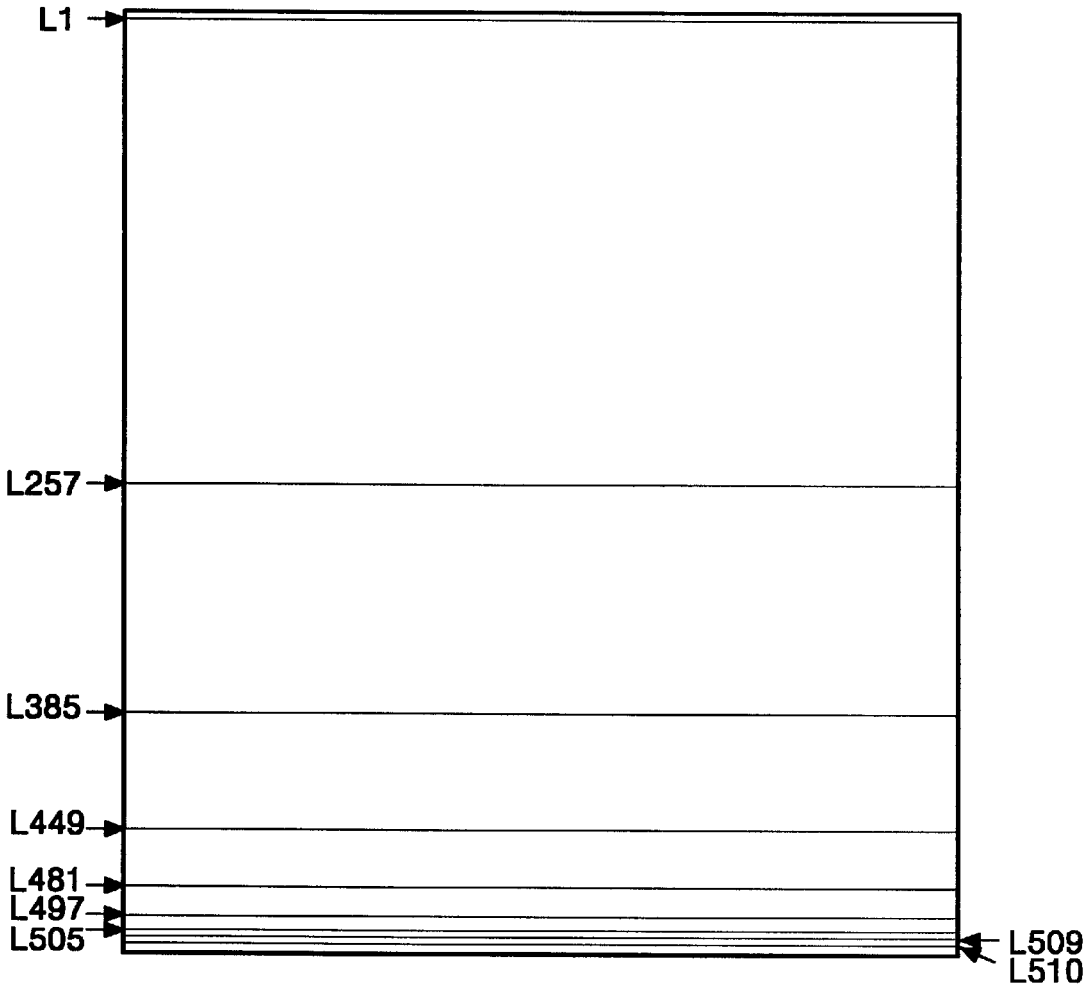
FIG.5A RELATED ART
FIGS. 5A and 5B represent a driving sequence in the conventional sub-frame driving method.
Figure 5B:
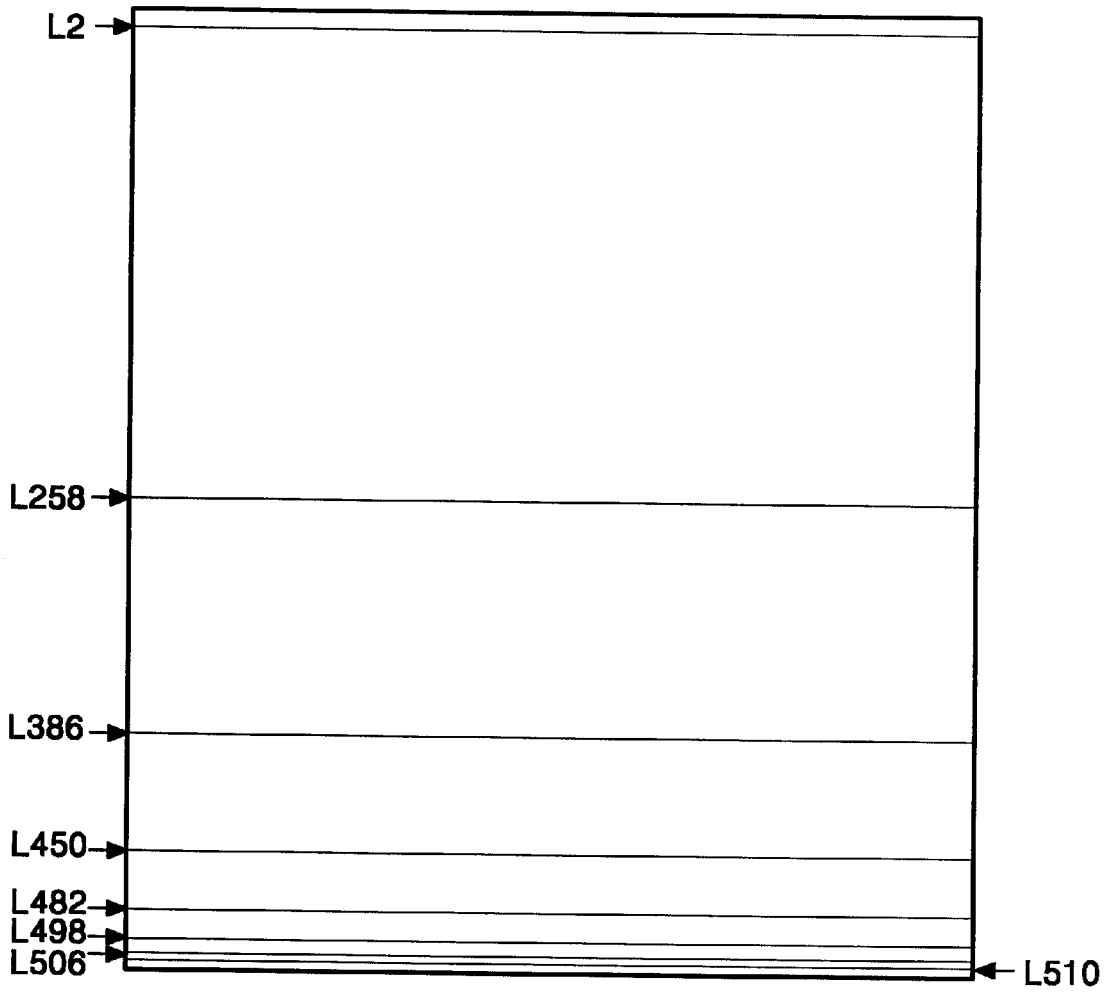
FIG.5B RELATED ART
Figure 6:
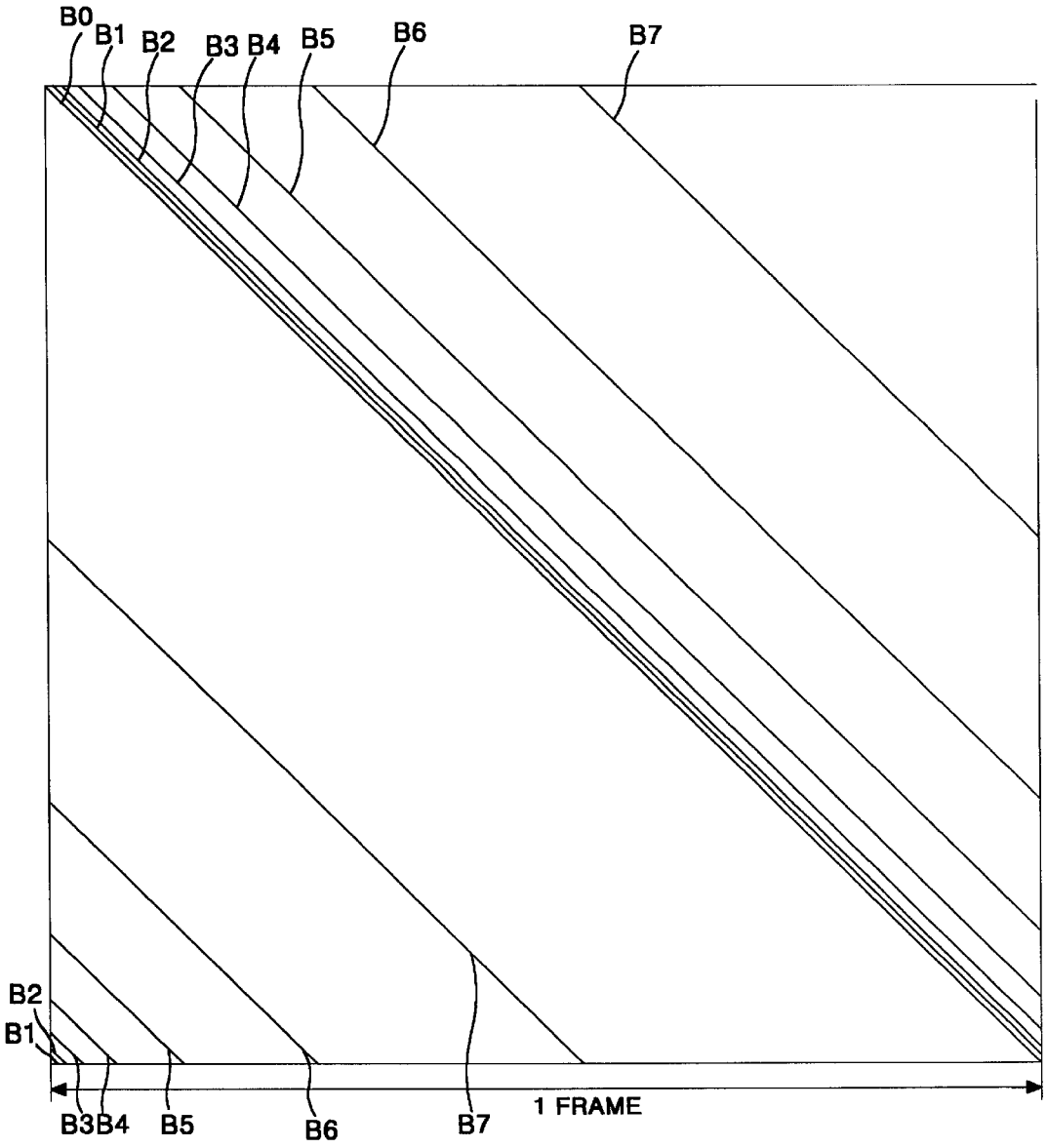
FIG.6 RELATED ART
FIG. 6 represents an addressing process for one frame according to the conventional sub-frame driving method on a time basis.
Figure 7:
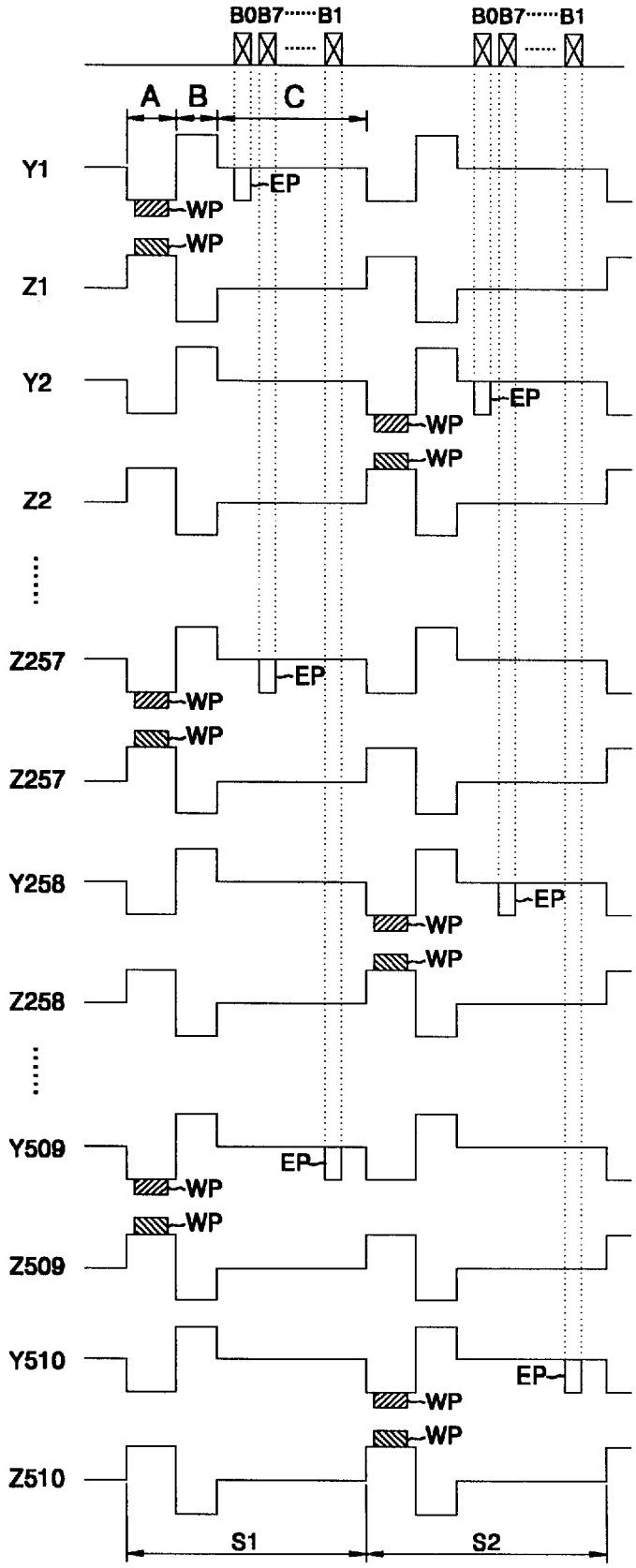
FIG.7 RELATED ART
FIG. 7 is driving waveform diagrams corresponding to a case where an addressing is carried out by the selective erasing method in the conventional sub-frame driving method.
Figure 8:
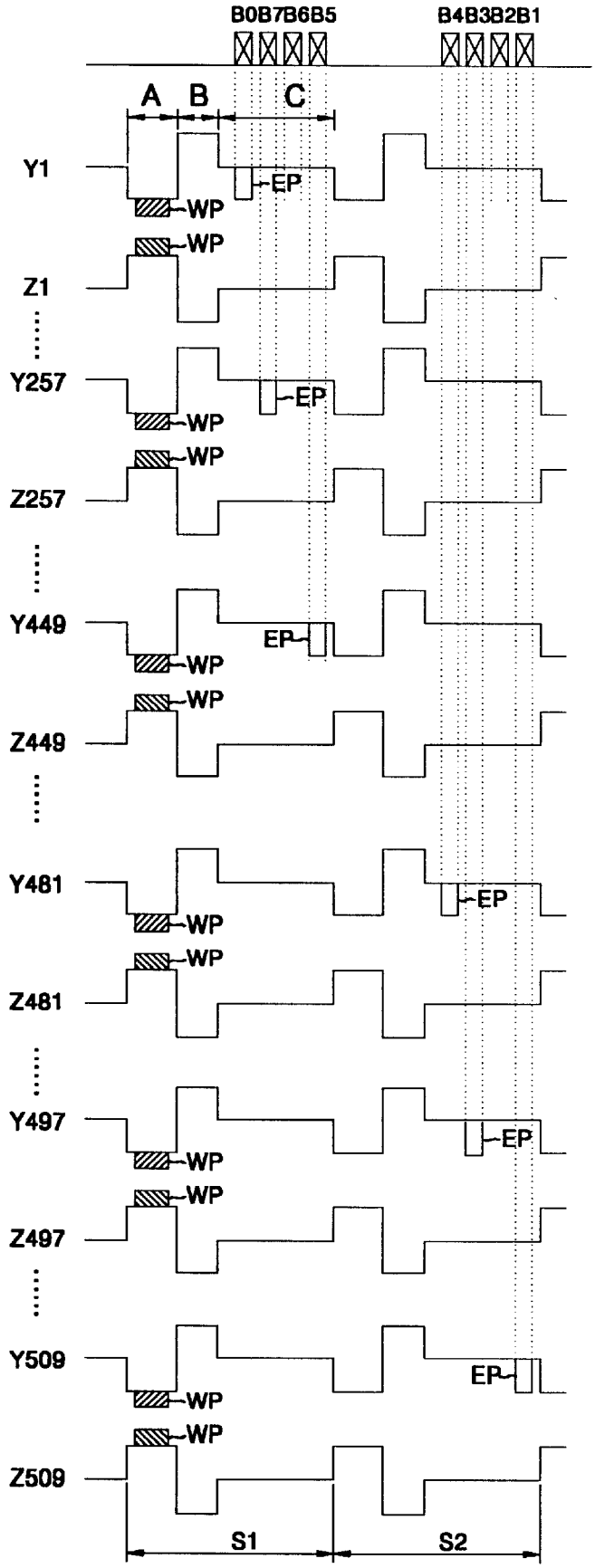
FIG. 8 is driving waveform diagrams corresponding to a PDP driving method according to a first embodiment of the present invention.

Referring to FIG. 8, there is shown driving waveforms corresponding to a PDP driving method according to a first embodiment of the present invention. More specifically, FIG. 8 represents driving waveforms corresponding to a case where an addressing is carried out by employing the selective erasure in the sub-frame driving method. The driving waveforms are applied to a display panel 10 of the PDP shown in FIG. 1. In this case, it is assumed that the number of scanning lines is 510 as mentioned above.

A sustaining pulse having the same frequency and an opposite polarity is successively applied to the first sustaining electrodes Y1 to Y510 and the second sustaining electrodes Z1 to Z510. Four scanning lines are addressed every sustaining pulse period. In other words, 8lines are scanned in one sustaining pulse period in the prior art while the 8 lines are scanned with being divided in two sustaining pulses in the present invention. In this case, since the present invention can reduce a period of the sustaining pulse into ½ compared with the prior art scanning each 8 line, it can increase a frequency of the sustaining pulse into twice of that in the prior art. In other words, in order to express the 256 gray scales, 510 sustaining pulses are applied in the prior art while 1020 sustaining pulses are applied in the present invention.

More specifically, 8 scanning lines L1, L257, L385, L449, L481, L497, L505 and L509 to be addressed are selected in a writing region A in the first sustaining interval applied with the first sustaining pulse. In this case, in the writing region A, A writing pulse added to the sustaining pulse is applied to the first sustaining electrodes Y1, Y257, Y385, Y449, Y481, Y497, Y505 and Y509 and the second sustaining electrodes Z1, Z257, Z385, Z449, Z481, Z497, Z505 and Z509 to generate a writing discharge. Then, the discharge is sustained in a sustaining region B applied with the sustaining pulse having a polarity contrary to the writing region A. Next, in an address region C, 4 scanning lines L1, L257, L385 and L449 in the 8 scanning lines L1, L257, L385, L449, L481, L497, L505 and L509 are first addressed. In this case, an erasing pulse is line-sequentially applied to the first sustaining electrodes Y1, Y257, Y385 and Y449 of the corresponding scanning lines L1, L257, L385 and L449. At the same time, a data pulse for one horizontal line corresponding to each of B0, B7, B6 and B5 is applied to the data electrodes X1 to X1920 with being synchronized with the corresponding erasing pulse. As a result, the discharge is selectively erased in accordance with a logical state of the data pulse at the discharge cells of the corresponding scanning lines L1, L257, L385 and L449. Herein, the discharge cells in which the discharge has not been erased sustain the discharge until the next address time by a sustaining pulse applied successively later. In the address interval of the second sustaining pulse, the remaining 4 scanning lines L481, L497, L505 and L509 are addressed in the above manner.

As described above, the first embodiment of the present invention, performs an addressing for each 4 line every sustaining pulse period, so that it allows an address interval to be shorter compared with the prior art performing an addressing for each 8 line. As a result, it can increase a frequency of the sustaining pulse into about twice of that in the prior art to thereby improve the brightness. In this case, B0 has a bit weighting value corresponding to 4 sustaining pulses; B1 has a bit weighting value corresponding to 8 sustaining pulses; B2 has a bit weighting value corresponding to 16 sustaining pulses; B3 has a bit weighting value corresponding to 32 sustaining pulses; B4 has a bit weighting value corresponding to 64 sustaining pulses; B5 has a bit weighting value corresponding to 128 sustaining pulses; B6 has a bit weighting value corresponding to 256 sustaining pulses; and B7 has a bit weighting value corresponding to 512 sustaining pulses.

Figure 9A:
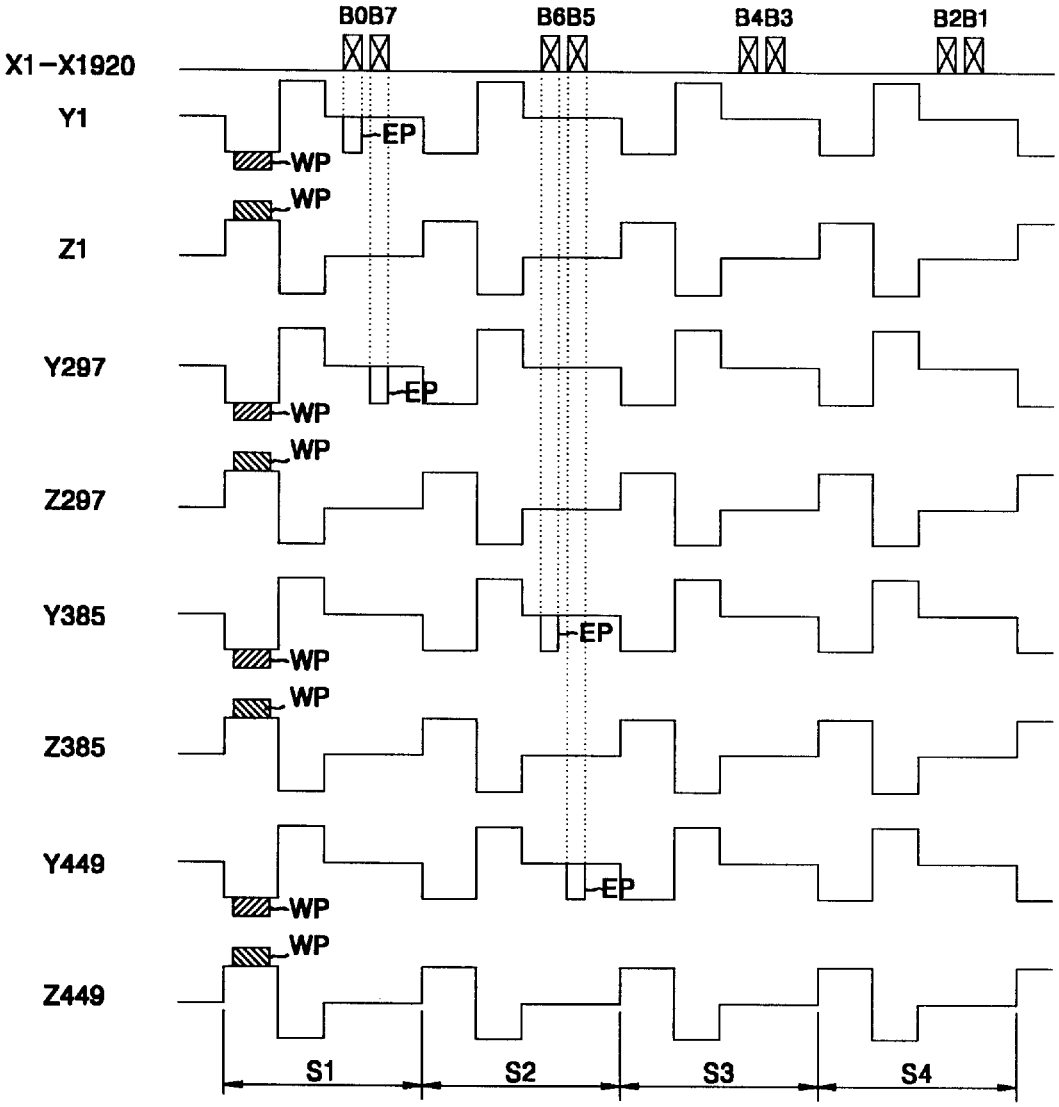
FIGS. 9A and 9B are driving waveform diagrams corresponding to a PDP driving method according to a second embodiment of the present invention.
Figure 9B:
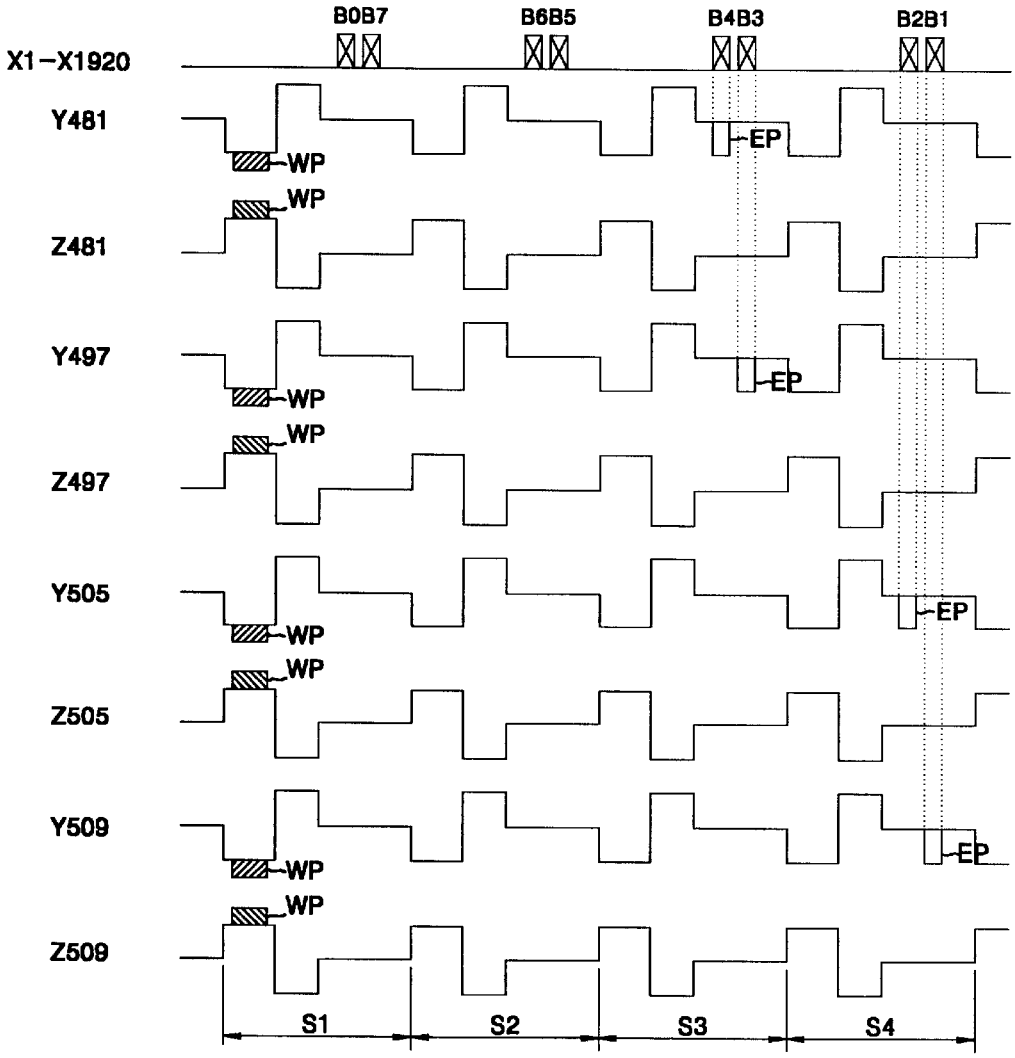

FIGS. 9A and 9B represent driving waveforms corresponding to a PDP driving method according to a second embodiment of the present invention. Referring now to FIGS. 9A and 9B, a sustaining pulse having the same frequency and an opposite polarity is successively applied to the first sustaining electrodes Y1 to Y510 and the second sustaining electrodes Z1 to Z510. Two scanning lines are addressed every sustaining pulse period. In other words, 8 lines are scanned in one sustaining pulse period in the prior art while the 8 lines are scanned with being divided in four sustaining pulses in the present invention. In this case, since the present invention can reduce a period of the sustaining pulse into ¼ compared with the prior art scanning each 8 line, it can increase a frequency of the sustaining pulse into four times of that in the prior art. In other words, in order to express the 256 gray scales, 510 sustaining pulses are applied in the prior art while 2040 sustaining pulses are applied in the present invention.

More specifically, 8 scanning lines L1, L257, L385, L449, L481, L497, L505 and L509 to be addressed are selected in a writing region A in the first sustaining interval S1 shown in FIG. 9A. In this case, in the writing region A, a writing pulse WP added to the sustaining pulse is applied to the first sustaining electrodes Y1, Y257, Y385, Y449, Y481, Y497, Y505 and Y509 and the second sustaining electrodes Z1, Z257, Z385, Z449, Z481, Z497, Z505 and Z509 to generate a writing discharge. Then, the discharge is sustained in a sustaining region B. Next, in an address region C, two scanning lines L1 and L257 in the 8 scanning lines L1, L257, L385, L449, L481, L497, L505 and L509 are first addressed by the selective erasing method. In this case, an erasing pulse is line-sequentially applied to the first sustaining electrodes Y1 and Y257 at the corresponding scanning lines L1 and L257. At the same time, a data pulse for one horizontal line corresponding to each of B0 and B7 is applied to the data electrodes X1 to X1920 with being synchronized with the corresponding erasing pulse. As a result, the discharge is selectively erased in accordance with a logical state of the data pulse at the discharge cells of the corresponding scanning lines L1 and L257. Herein, the discharge cell in which the discharge has not been erased sustains the discharge until the next address time by a sustaining pulse applied successively later. In the address region of the second sustaining interval S2 applied with the second sustaining pulse, the next two scanning lines L385 and L449 are addressed by the above-mentioned selective erasing method. In this case, data pulses corresponding to B6 and B5 are applied to the scanning lines L385 and L449, respectively. Subsequently, in the address region of the third sustaining interval S3 as shown in FIG. 9B, the next two scanning lines L481 and L497 are selected to write B4 and B3 data into the corresponding scanning lines L481 and L497. Then, in the address region of the fourth sustaining interval S4, the remaining two scanning lines L505 and L509 are selected to write B3 and B2 data into the corresponding scanning lines L505 and L509.

As described above, the second embodiment of the present invention performs an addressing for each 2 line every sustaining pulse period, so that it allows an address interval to be shorter compared with the prior art performing an addressing for each 8 line. As a result, it can increase a frequency of the sustaining pulse into about four times of that in the prior art to thereby improve the brightness. In this case, B0 has a bit weighting value corresponding to 8 sustaining pulses; B1 has a bit weighting value corresponding to 16 sustaining pulses; B2 has a bit weighting value corresponding to 32 sustaining pulses; B3 has a bit weighting value corresponding to 64 sustaining pulses; B4 has a bit weighting value corresponding to 128 sustaining pulses; B5 has a bit weighting value corresponding to 256 sustaining pulses; B6 has a bit weighting value corresponding to 512 sustaining pulses; and B7 has a bit weighting value corresponding to 1024 sustaining pulses.

Furthermore, one line can be scanned every sustaining pulse period by a sub-frame driving method according to the third embodiment of the present invention. In this case, since the present invention can reduce a period of the sustaining pulse into ⅛ compared with the prior art scanning each 8 line, it can increase a frequency of the sustaining pulse into eight times of that in the prior art. In other words, 510 sustaining pulses are applied in the prior art while 4080 sustaining pulses are applied in the third embodiment of the present invention. In this case, B0 has a bit weighting value corresponding to 16 sustaining pulses; B1 has a bit weighting value corresponding to 32 sustaining pulses; B2 has a bit weighting value corresponding to 64 sustaining pulses; B3 has a bit weighting value corresponding to 128 sustaining pulses; B4 has a bit weighting value corresponding to 256 sustaining pulses; B5 has a bit weighting value corresponding to 512 sustaining pulses; B6 has a bit weighting value corresponding to 1024 sustaining pulses; and B7 has a bit weighting value corresponding to 2048 sustaining pulses. As a result, the third embodiment is capable of improving the brightness dramatically compared with the prior art scanning each 8 line in one sustaining pulse period.

The division of the addressing process as mentioned above can be applied similarly to the selective writing addressing method. In this case, an addressing is performed for four lines, two lines or one line every sustaining pulse period after selecting the corresponding 8 lines in a certain period of the sustaining pulse by the erasing discharge. As a result, a frequency of the sustaining pulse is increased, so that the brightness can be improved.

As described above, the PDP driving method according to the present invention performs an addressing for X scanning lines by dispersing it into a plurality of sustaining pulse periods when an addressing is performed in a unit of X scanning lines spaced at an interval corresponding to a multiple of two. Accordingly, an addressing interval per sustaining pulse is reduced and hence a period of the sustaining pulse is reduced to that extent, so that a frequency of the sustaining pulse can be increased. As a result, the brightness proportional to the frequency of sustaining pulse is improved in such a manner to be applicable to a high-resolution PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel driving method employing a sub-frame system, comprising the steps of:

simultaneously selecting a plurality of scanning lines spaced at an interval corresponding to a multiple of two in accordance with a gray scale to initiate a discharge;

sequentially addressing the plurality of scanning lines by an erasing discharge according to a data; and sustaining the discharge at the addressed scanning lines by a certain period of sustaining pulse, wherein an addressing for the plurality of scanning lines is performed with being dispersed in a plurality of sustaining pulse period, wherein said addressing is performed by applying an erasing pulse for the erasing discharge in such a manner that the erasing pulse is dispersed in the sustaining pulse, wherein said addressing is performed over a period corresponding to a multiple of 2 of the sustaining pulse, and wherein when 256 gray levels are implemented, said addressing step includes applying 8 erasing pulses required for an addressing of 8 scanning lines written simultaneously in such a manner that the erasing pulses are dispersed, by the four unit, in two sustaining pulses, thereby selecting the 8 scanning lines sequentially in accordance with the data.

2. A plasma display panel driving method employing a sub-frame system, comprising the steps of:

simultaneously selecting a plurality of scanning lines spaced at an interval corresponding to a multiple of two in accordance with a gray scale to initiate a discharge;

sequentially addressing the plurality of scanning lines by an erasing discharge according to a data; and sustaining the discharge at the addressed scanning lines by a certain period of sustaining pulse, wherein an addressing for the plurality of scanning lines is performed with being dispersed in a plurality of sustaining pulse period, wherein said addressing is performed by applying an erasing pulse for the erasing discharge in such a manner that the erasing pulse is dispersed in the sustaining pulse, wherein said addressing is performed over a period corresponding to a multiple of 2 of the sustaining pulse; and wherein when 256 gray levels are implemented, said addressing step includes applying 8 erasing pulses required for an addressing of 8 scanning lines written simultaneously in such a manner that the erasing pulses are dispersed, by the two unit, in four sustaining pulses, thereby selecting the 8 scanning lines sequentially in accordance with the data.

3. A plasma display panel driving method employing a sub-frame system, comprising:

simultaneously selecting n scanning lines spaced at an interval corresponding to a multiple of two in accordance with a gray scale to initiate a discharge;

sequentially addressing the n scanning lines by an erasing discharge according to a data; and applying a certain period of sustaining pulse to the addressed scanning lines to maintain a display, wherein erasing pulses for addressing the n scanning lines are distributed into at least two groups according to a frequency of the sustaining pulse and the distributed erasing pulses are applied to the n scanning lines for the sustaining pulse periods different from each other so that an addressing for the n scanning lines is performed with being dispersed in the at least two sustaining pulse periods.

4. The plasma display panel driving method as claimed in claim 3, wherein, when 256 gray levels are implemented, said addressing step includes applying 8 erasing pulses required for an addressing of 8 scanning lines written simultaneously in such a manner that the erasing pulses are dispersed, byd the four unit, in two sustaining pulses, thereby selecting the 8 scanning lines sequentially in accordance with the data.

5. The plasma display poanel driving method as claimed in claim 3, wherein, when 256 gray levels are implemented, said addressing step includes applying 8 erasisng pulses required for an addressisng of 8 scanning lines written simultaneously in such a manner that the erasing pulses are dispersed, by the two unit, in four sustaining pulses, thereby selecting the 8 scanning lines sequentially in accordance with the data.

* * * * *